US007962968B2

(12) United States Patent
Kordecki

(10) Patent No.: US 7,962,968 B2
(45) Date of Patent: Jun. 21, 2011

(54) PROTECTIVE RIB AND LOWER BACK PADS WITH RELEASE MECHANISMS

(76) Inventor: Michael E Kordecki, Vernon Hills, IL (US)

( * ) Notice: Subject to any disclaimer, the term of this patent is extended or adjusted under 35 U.S.C. 154(b) by 193 days.

(21) Appl. No.: 12/319,429

(22) Filed: Jan. 6, 2009

(65) Prior Publication Data

US 2010/0170029 A1 Jul. 8, 2010

(51) Int. Cl.
*A41D 13/00* (2006.01)

(52) U.S. Cl. ..... 2/44

(58) Field of Classification Search ..... 2/102, 94, 2/461, 462, 463–465, 44, 45, 69, 2.5
See application file for complete search history.

(56) References Cited

U.S. PATENT DOCUMENTS 4,317,237 A * 3/1982 Porte ..... 2/464
4,694,505 A * 9/1987 Flosi et al. ..... 2/462
5,029,341 A 7/1991 Wingo, Jr.
5,204,993 A * 4/1993 Siemens ..... 2/461
5,337,417 A 8/1994 Whiteside et al.
5,530,966 A * 7/1996 West ..... 2/462

OTHER PUBLICATIONS

Pending U.S. Appl. No. 12/290,510, Kordecki, filed Oct. 31, 2008.

* cited by examiner

*Primary Examiner* — Tejash Patel
(74) *Attorney, Agent, or Firm* — The Law Office of Paul C. Pecoraro, P.C.; Paul C. Pecoraro

(57) ABSTRACT

This invention concerns improved protective rib and lower back pads for protecting an individual wearing the protective rib and lower back pads against impact to the ribs and/or lower back region of the human body. The improvement comprises protective rib and lower back pads with release mechanisms that allow the protective rib and lower back pads to be safely and easily detached from its corresponding pair of protective shoulder pads while the individual wearing the protective rib and lower back pads is maintained in the supine position, thus decreasing the risk of a secondary injury to the individual wearing the protective rib and lower back pads as the protective rib and lower back pads and associated protective shoulder pads are removed.

2 Claims, 5 Drawing Sheets

PROTECTIVE RIB AND LOWER BACK PADS WITH RELEASE MECHANISMS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates generally to protective rib and lower back pads such as those worn by individuals participating in athletic activities. In particular, this invention improves presently available protective rib and lower back pads with a feature that allows emergency medical personnel or others to safely and easily detach the protective rib and lower back pads from the protective shoulder pads that the individual is wearing without substantially repositioning the individual while the individual is in the supine position, thus significantly decreasing or eliminating the possibility of the individual suffering a secondary cervical spine or neck injury.

2. Description of the Related Art

Protective rib and lower back pads are commonly used by athletes and other individuals in conjunction with protective shoulder pads to protect the individual's torso from impact that may result in injury. For example, protective shoulder pads, rib pads and lower back pads are utilized in sports where collision is inherent and produces a significant risk of injury, such as football and hockey. The protective rib and lower back pads generally attach to the athlete's protective shoulder pads and suspend down from the protective shoulder pads.

When neck or cervical spine injuries occur, protective shoulder pads, rib pads and lower back pads themselves become a risk factor for secondary injury during the course of initial medical evaluation and management. While medical personnel provide stabilization to the wearer's spine, the protective shoulder pads must be removed from the injured athlete while lying supine to aid in the diagnosis and treatment of a suspected cervical spine or neck injury. The suspended connection of the protective rib and lower back pads provides a greater burden in the removal of the protective shoulder pads due to the weight of the individual's torso on the protective rib and lower back pads while the individual is lying supine.

These improved protective rib and lower back pads provide a solution to the challenges of diagnosing and treating suspected neck and spinal injuries. By providing for the disconnection of the protective rib and lower back pads from the posterior elements of the protective shoulder pads while maintaining the neck and spine of the individual in the neutral position, these improved protective rib and lower back pads substantially eliminate the risk of further injury to an individual wearing protective shoulder pads. The invention provides for detachment of the protective rib and lower back pads from the protective shoulder pads by simple release mechanisms which are easily accessible by first responders and medical professionals. Once the protective shoulder pads, rib pads and lower back pads are removed, medical personnel can more effectively diagnose and treat the individual suspected of a cervical spine or neck injury and the injured athlete's spine may be accessed for radiographic evaluation.

BRIEF SUMMARY OF THE INVENTION

Utilizing mechanical fasteners or equivalent, the protective rib and lower back pads may be easily and efficiently detached from the posterior portions of their corresponding protective shoulder pads while the individual wearing the protective rib and lower back pads is in the supine position. As a result, the individual suspected of a cervical spine or neck injury need not be repositioned during the detachment of the protective rib and lower back pads, thus substantially decreasing the possibility of suffering a secondary cervical spine or neck injury. The protective rib and lower back pads may be removed laterally from underneath the individual if desired, and the protective rib and lower back pads may be subsequently reattached to their corresponding protective shoulder pads for future use if desired.

Upon removal of the protective rib and lower back pads and their corresponding protective shoulder pads, medical personnel and others gain access to the location of the suspected cervical spine and neck injury to treat the injury. Additionally, radiographic imaging machines can be positioned to provide clearer images of the suspected injury upon removal of the protective rib and lower back pads and their corresponding protective shoulder pads.

BRIEF DESCRIPTION OF THE SEVERAL VIEWS OF THE DRAWINGS

For a better understanding of the invention, reference may be had to the following detailed description taken in conjunction with the accompanying drawings in which.

DETAILED DESCRIPTION OF THE INVENTION

The protective rib and lower back pads 2 shown in FIG. 1, FIG. 2, FIG. 3, FIG. 4 and FIG. 5 in accordance with the present invention protect the ribs and lower back of the individual wearing the protective rib and lower back pads 2. The protective rib and lower back pads 2 are capable of being disconnected from their corresponding protective shoulder pads 4 while the individual wearing the protective shoulder pads 4 is in the supine position without significantly moving the individual.

Figure 1:
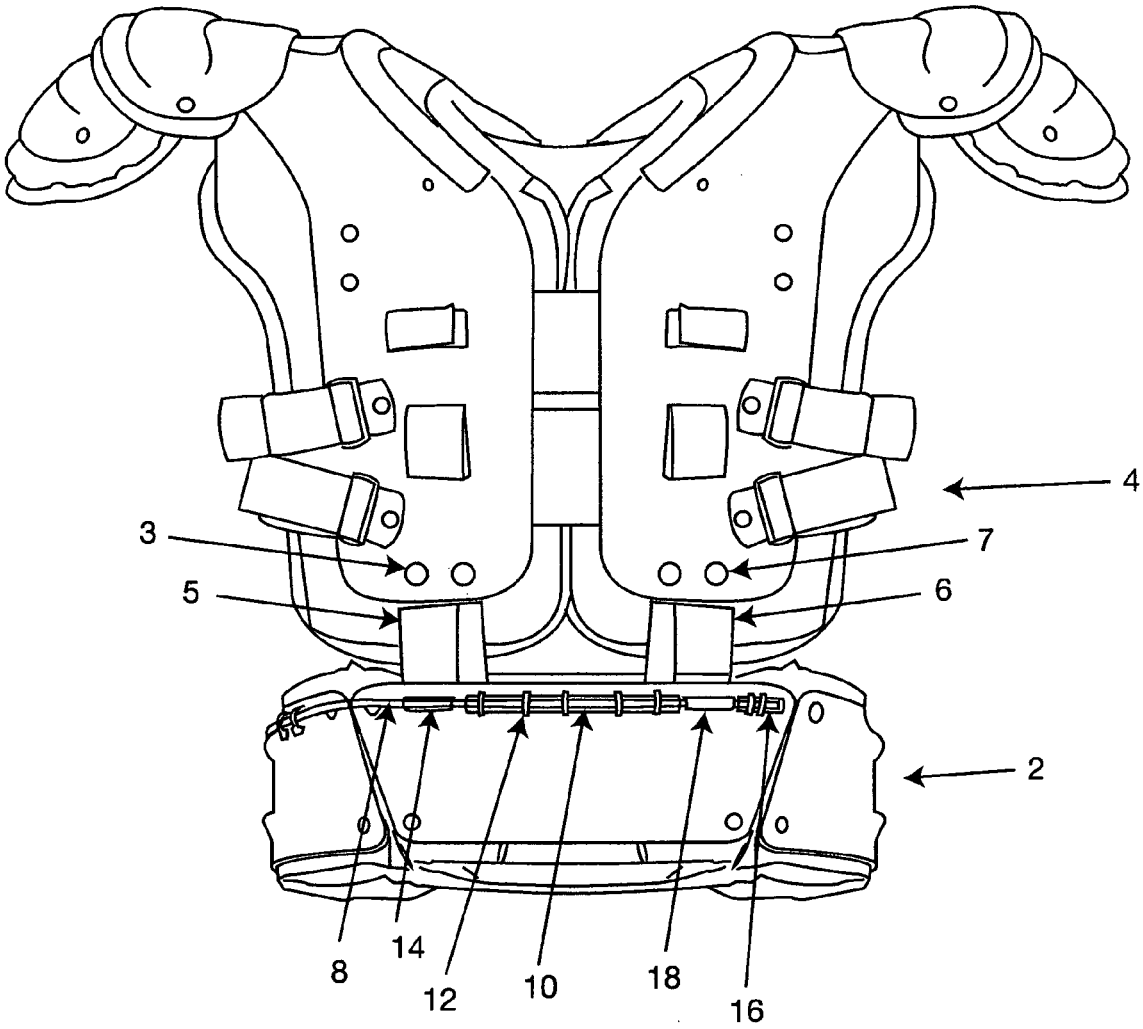
FIG. 1 illustrates a distal plan view of one embodiment of the present invention with a removable retaining cable shown as the removable mechanical connection that couples the protective rib and lower back pads to the protective shoulder pads.

As can be seen in FIG. 1, the protective rib and lower pads 2 are mechanically coupled to their corresponding protective shoulder pads 4 with the left harness 5 and the right harness 6. The left harness 5 is attached to the protective shoulder pads 4 with rivets 3 and the right harness 6 is attached to the protective shoulder pads 4 with rivets 7. The opposite end of the left harness 5 forms the left retaining loop 14 that passes through the left retention aperture in the protective rib and lower back pads 2 and the opposite end of the right harness 6 forms the right retaining loop 18 that passes through the right retention aperture in the protective rib and lower back pads 2. The first end of retaining cable 8 is passed through retaining loop 14, then through cable guidance channel 10, then through retaining loop 18, and the first end of the retaining cable 8 terminates in the terminating channel 16. The removable retaining cable 8 prevents the left retaining loop 14 and the right retaining loop 18 from passing through the retention apertures in the body of the protective rib and lower back pads 2. The removable retaining cable 8 is guided along its desired path via guidance channel 10 to maintain ease of removal. The guidance channel 10 and the terminating channel 16 attach to the protective rib and lower back pads 2 with channel attaching ties 12. As an alternative to this embodiment of the invention, the guidance channel 10 can be manufactured into the protective rib and lower back pads 2 to form the guidance channel 10.

Figure 2:
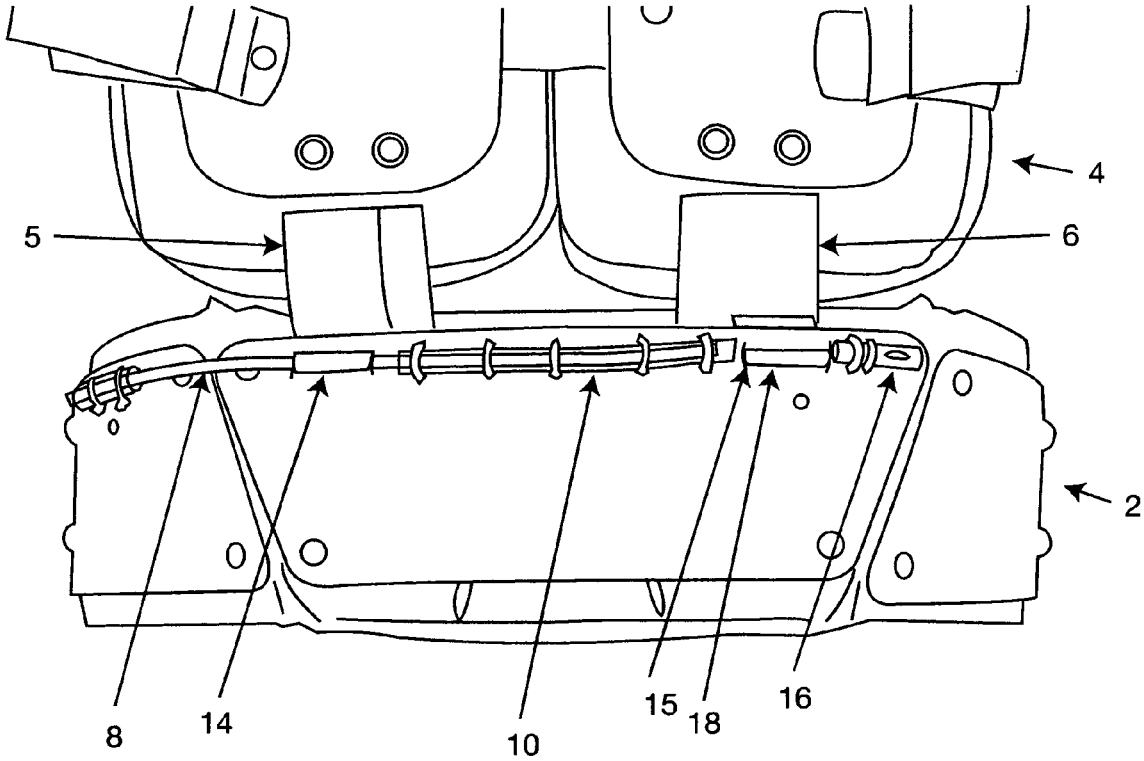
FIG. 2 illustrates a distal plan view of the same embodiment of the present invention as shown in FIG. 1, in which the removable retaining cable is removed from one protective rib and lower back pad retaining loop with the protective rib and lower back pad retaining loop remaining inserted in the protective rib and lower back pads retention aperture.

As can be seen in FIG. 2, the removable retaining cable 8 is partially removed from the protective rib and lower back pads 2. The removable retaining cable 8 is removed from the terminating channel 16 and the right retaining loop 18. The right retaining loop 18 may now be passed through the right retention aperture 15 in the protective rib and lower back pads 2, thus disconnecting the right portion of the protective shoulder pads 4 from the protective rib and lower back pads 2.

Figure 3:
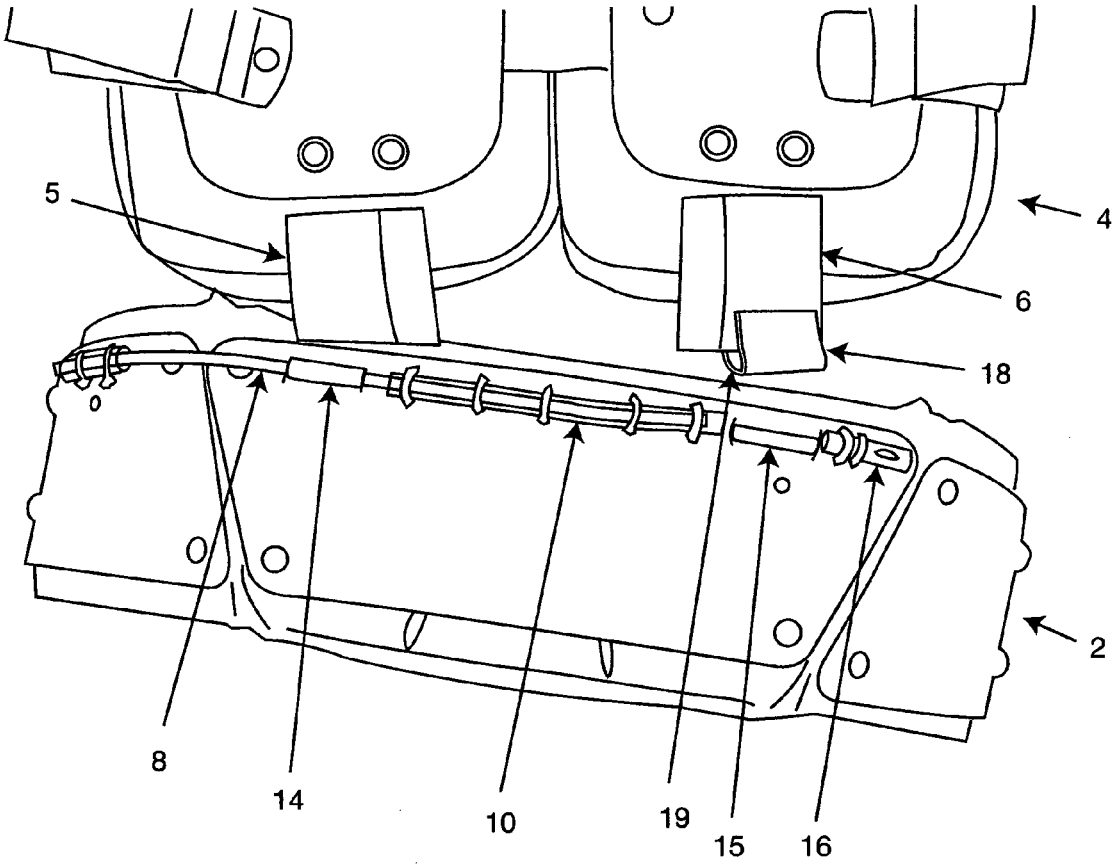
FIG. 3 illustrates a distal plan view of the same embodiment of the present invention as shown in FIG. 1, in which the removable retaining cable is removed from one protective rib and lower back pad retaining loop with the protective rib and lower back pad retaining loop evacuated from the protective rib and lower back pads retention aperture.

FIG. 3 illustrates the right retaining loop 18 removed from the right retention aperture 15 in the protective rib and lower back pads 2 and the right portion of the protective shoulder pads 4 disconnected from the protective rib and lower back pads 2, with the removable retaining cable 8 in the same position as in FIG. 2. The removable retaining cable 8 was routed through orifice 19 in the right retaining loop 18. As FIG. 3 illustrates, the right harness 6 incorporates the right retaining loop 18. To effectuate the removal of the right retaining loop 18 from the right retention aperture 15 in the protective rib and lower back pads 2, the right retaining loop 18 should be constructed of a pliable material that is cable of passing through the right retention aperture 15 while the individual wearing the protective rib and lower back pads 2 is in the supine position. In this embodiment, the right retaining loop 18 is riveted to the right harness 6. The retaining loop could optionally be manufactured into the harness as one piece. Here, the right retaining loop 18 is composed of Nylon, but any other pliable material capable of restraining the right retaining loop 18 is acceptable. Another feature of the right harness 6 is the material that the harness other than the right retaining loop 18 is composed of. It is generally desirable to produce the right harness 6 from a material that will not absorb moisture such as water or perspiration. The right harness 6 of this embodiment of the protective rib and lower back pads 2 is composed of nonabsorbent plastic; however, other material may be utilized, whether the material is nonabsorbent or not. The left harness 5 is also constructed of a nonabsorbent plastic material and incorporates a pliable retaining loop 14.

Figure 4:
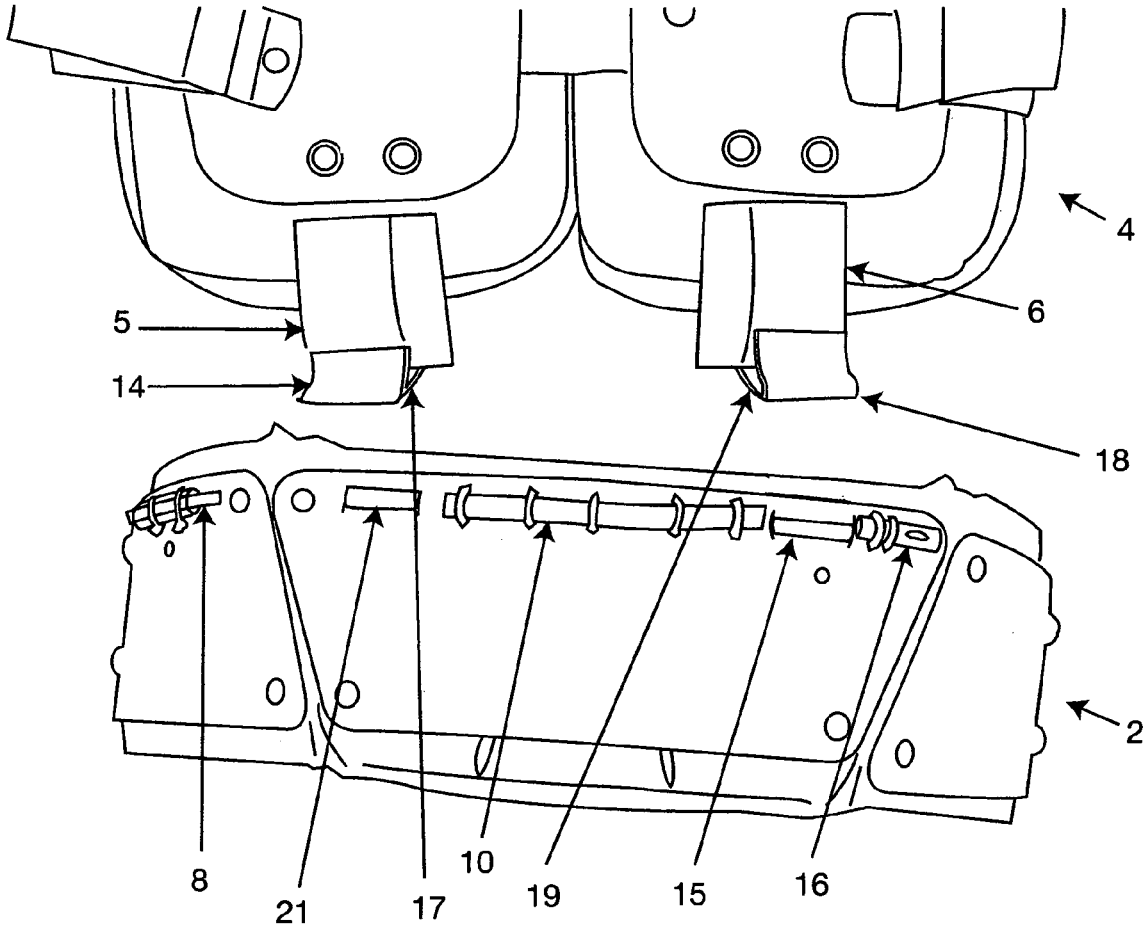
FIG. 4 illustrates a distal plan view of the same embodiment of the present invention as shown in FIG. 1, in which the removable retaining cable is removed from both protective rib and lower back pad retaining loops and both protective rib and lower back pad retaining loops are evacuated from the protective rib and lower back pads retention apertures, thus decoupling the protective rib and lower back pads from the protective shoulder pads.

Turning to FIG. 4, the removable retaining cable 8 is further removed from the protective rib and lower back pads 2. In this view, the removable retaining cable 8 is removed from the terminating channel 16, the right retaining loop 18, cable guidance channel 10, and the left retaining loop 14. The left retaining loop 14 may now pass through the left retention aperture 21 in the protective rib and lower back pads 2, and the right retaining loop 18 may now pass through the right retention aperture 15 in the protective rib and lower back pads 2. The removable retaining cable 8 was routed through orifice 19 in the right retaining loop 18 and through orifice 17 in the left retaining loop 14. In this state, the protective rib and lower back pads 2 may be completely disconnected from the protective shoulder pads 4. The protective shoulder pads 4 and the protective rib and lower back pads 2 may be recoupled for future use by passing the removable retaining cable 8 through the left retaining loop 14, through cable guidance channel 10, through the right retaining loop 18 and finally into the terminating channel 16 after passing the left terminating loop 14 through the left retention aperture 21 in the protective rib and lower back pads 2 and the right retaining loop 18 through the right retention aperture 15 in the protective rib and lower back pads 2.

Figure 5:
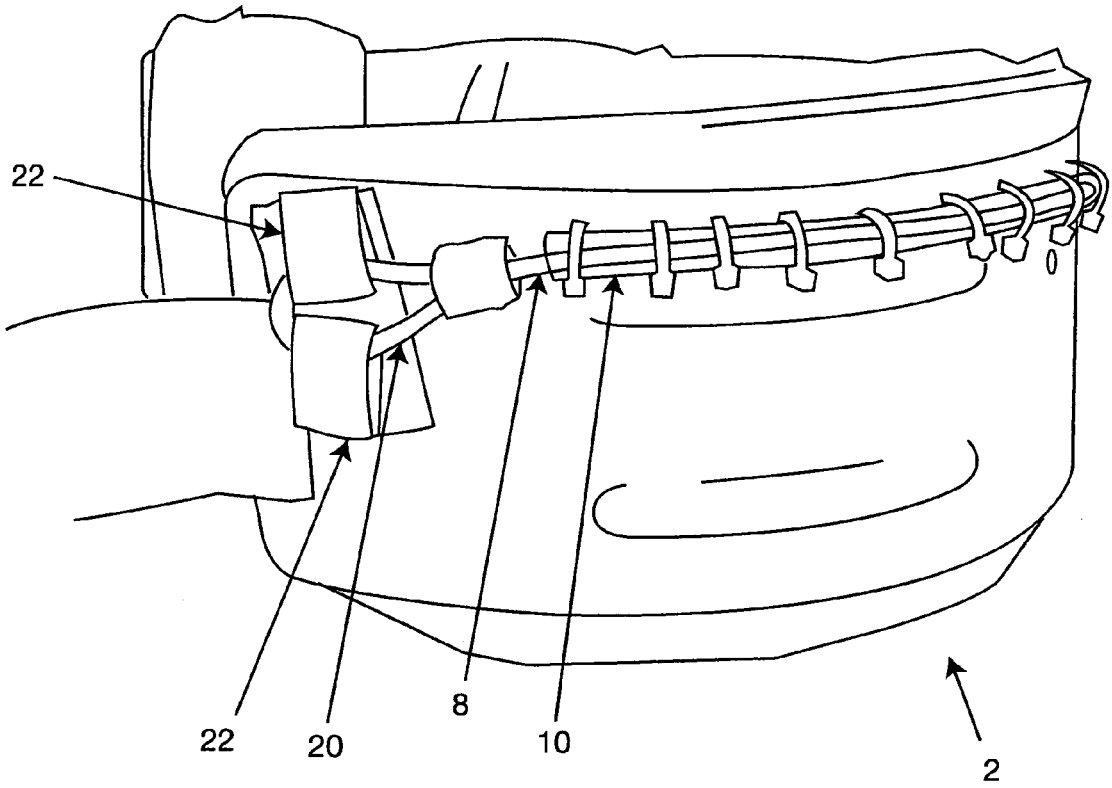
FIG. 5 illustrates a lateral prospective view of the embodiment of the present invention illustrated in FIG. 1, in which a loop on the anterior end of the retaining cable is used to remove the retaining cable from the harnesses that couple the protective rib and lower back pads to the protective shoulder pads.

FIG. 5 illustrates a pull loop 20 on the anterior end of the retaining cable 8. This pull loop 20 is used to extract the removable retaining cable 8 from cable guidance channel 10 of the protective rib and lower back pads 2. The pull loop 20 is retained in place with a hook and loop fastener 22 or other type of fastener.

It is to be understood that while certain forms of this invention have been illustrated and described, it is not limited thereto except insofar as such limitations are included in the following claims and allowable equivalents thereof.

The invention claimed is:

1. Protective rib and lower back pads comprising: a plurality of protective rib and lower back pads forming a flexible rib and lower back protector pad body for substantially encircling the ribs and lower back of the individual wearing said flexible rib and lower back protector pad body;

said plurality of protective rib and lower back pads operative to removably couple said plurality of protective rib and lower back pads at a plurality of locations to corresponding protective shoulder pads;

said plurality of locations comprising a retaining means for securing a plurality of retaining loops disposed in a first end of a plurality of coupling harnesses;

a coupling means for holding a second end of said plurality of retaining loops operative to removably couple to said corresponding protective shoulder pads, said plurality of protective rib and lower back pads operative to be decoupled from said protective shoulder pads while said plurality of protective rib and lower back pads are worn by said individual and said individual wearing said plurality of protective rib and lower back pads is lying in the supine position.

2. Protective rib and lower back pads as claimed in claim 1 wherein said retaining means is an aperture;

said coupling means is a retaining cable;

said retaining cable comprising a first end and a second end;

said plurality of retaining loops operative to receive said first end of said retaining cable and operative to removably couple said plurality of protective rib and lower back pads to their corresponding protective shoulder pads;

said first end of said retaining cable inserted through said plurality of retaining loops;

said second end of said retaining cable operative to remove said retaining cable from said plurality of retaining loops.

* * * * *